United States Patent [19]

Cox

[11] 4,384,428

[45] May 24, 1983

[54] SECURITY CLOSURE

[75] Inventor: Roy L. Cox, Greenville, N.C.

[73] Assignee: Frank Catricola, New York, N.Y.

[21] Appl. No.: 217,087

[22] Filed: Dec. 16, 1980

[51] Int. Cl.[3] ..... E06B 3/68
[52] U.S. Cl. ..... 49/56; 49/57
[58] Field of Search ..... 49/56, 57

[56] References Cited

U.S. PATENT DOCUMENTS 2,043,835 6/1936 McGuiness ..... 49/56 X

FOREIGN PATENT DOCUMENTS 2051195 1/1981 United Kingdom ..... 49/56

*Primary Examiner*—Kenneth Downey
*Attorney, Agent, or Firm*—Arthur T. Fattibene

[57] ABSTRACT

A security gate or closure for securing an access opening or fire escape against unauthorized entry defined by a frame circumscribing the opening to be secured; a closure therefor; and a locking bar for securing the closure without a key lock which will prohibit and/or deter unauthorized entry and which can be quickly opened to provide for rapid exit in case of fire or other emergency situations.

5 Claims, 5 Drawing Figures

SECURITY CLOSURE

PRIOR ART

Heretofore serious security problems have been encountered in securing fire escapes and other access and/or exit openings against unauthorized entry. In many urban and highly dense populated areas fire escapes and/or other public access openings can be guarded by gates or closures; which by local law or ordinances, cannot be secured by a key lock or other locking device which cannot be readily opened manually in case of fire or other emergency for rapid exit. Because of such local ordinances, fire escapes and other access openings have been secured by folding type gates which are latched in a manner whereby the same can be opened or forced with little or any effort by a would be unauthorized person for entry to an apartment or residence service by such fire escape or access opening. For these reasons many residences and/or offices which open to such poorly secured fire escapes and/or access opening such as street level windows and the like become easily victimized by unlawful entry.

OBJECTS

An object of this invention is to provide a relatively simple, expedient and positive acting security gate which will prohibit unauthorized entry and which can be readily opened in a simple and expedient manner without the need of any keys or other tool, and thereby satisfying any local restriction which bars the use of key locked doors or gates for securing public exit openings such as fire escapes and the like.

Another object is to provide an improved security closure which is rugged in construction and which can be readily secured and/or opened from the inside of the area secured thereby.

Another object is to provide a security closure which can be readily applied to systems utilizing various types of folding and/or hinged type closures.

BRIEF SUMMARY OF THE INVENTION

The foregoing objects and other features of this invention are attained by a security gate which is defined by a rigid frame structure sized to fit an access or exit opening to be secured and a closure in the form of a hinged door or folding door connected to the frame for movement between an open and closed or secured position. The frame structure is formed with opposed structural members, each having a rear flange extending in the plane of the closure and slightly spaced therefrom when the closure is in the closed position. The closure which may comprise either a single panel or a plurality of connected folding panels is secured in the closed position by a locking bar which is deposed between the closure and the flanges of the opposed structural frame members, and which locking bar includes a dead bolt located so as to define a movable extension of the locking bar. The arrangement is such that when the dead bolt is manually turned to extend the bolt, it latches and locks the locking bar transversely of the closure so as to prohibit one from forcing the closure inwardly. Also, the dead bolt can be readily retracted from the inside to render the locking bar readily removable for rapid exit. A protective housing circumscribes the dead bolt lock to further deter unauthorized tampering with the security gate or closure.

FEATURES

A feature of this invention resides in a security gate which includes a frame structure which is constructed to fit an access opening and to which a closure is hingedly connected and secured by a locking bar which is releaseably secured between opposed frame members.

Another feature resides in a security gate secured by a locking bar having a movable extension controlled by a dead bolt which is manually actuated without a key to effect rapid securing and unsecuring of the gate.

Another feature resides in a unitary security gate which can be readily applied to any access opening and which will comply with local ordinances requiring a keyless lock for rapid exit.

Other features and advantages will become readily apparent when considered in view of the drawing and specification in which.

DETAILED DESCRIPTION

Figure 2:
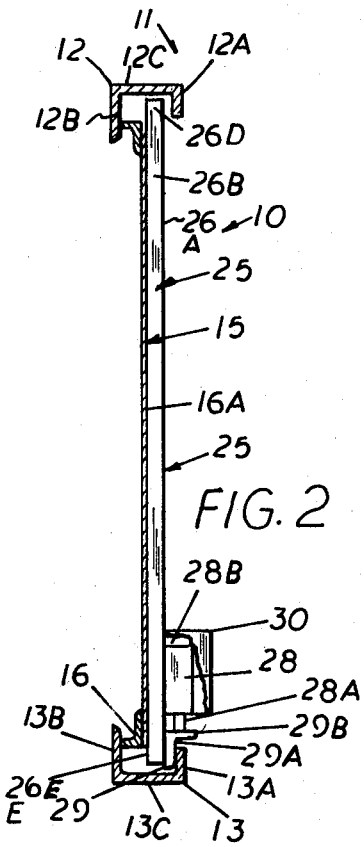
FIG. 2 is a sectional view taken along line 2—2 on FIG. 1.

Referring to the drawings there is shown therein a security gate or closure 10 for securing an access opening to a building or apartment. The closure or security gate 10 herein described is particularly applicable for use in securing a fire escape or other like public exit opening to protect against unauthorized entry while at the same time providing a safe and readily releasable gate, which can be operated between an opened or secured position without resorting to any key or other tool so as to facilitate a rapid exit in case of fire or other emergency. The gate, as herein described, will thus secure an opening and at the same time satisfy any local ordinance which requires a quick and rapid form of exit independent of any type of key actuated locking device.

The security gate or closure comprises a frame structure 11 which is shown as being formed of structural members rectangularly disposed to define top and bottom members 12 and 13, and opposed interconnected side members 14—14. The top and bottom structural members 12 and 13 are formed of a rigid member, and as shown comprises a generally channel shaped member having a rear flange 12A, 13A; a front flange 12B, 13B and an interconnected web portion 12C, 13C. The opposed interconnected side members 14—14 may be formed of an angular structural member having a front leg 14A complementing the the front flange 12B and 13B of the top and bottom members 12 and 13, and a connected side leg 14B defining the side perimeters of the frame 10. As shown, the front flanges 12B, 13B are made slightly longer than the rear flanges 12A and 13A, and thus flanges 12B and 13B together with front legs 14A of the side members 14 define a circumscribing stop to limit the closure from moving through the frame 11 in the closed position.

Hinged to one side member 14 of the frame 11 is a closure 15 which is free to swing between an open and closed position. As shown, in FIG. 4, the closure 15 may comprise a single panel unit or as shown in FIGS.

1 to 3 a multiple panel unit. In either event the respective closure panel is defined by a circumscribing closure frame 16 formed of rectangularly disposed structural frame members which may comprise an angle member wherein one leg portion defines a front and the other leg defines the periphery of the closure frame 16. A suitable grill cover or lattice construction 16A is extended over and secured to the closure frame 16 by suitable means such as welding or the like. Where the closure is formed as a single panel; it is hinged to the side member 14 of the frame 11 by suitable hinges 17.

Figure 1:
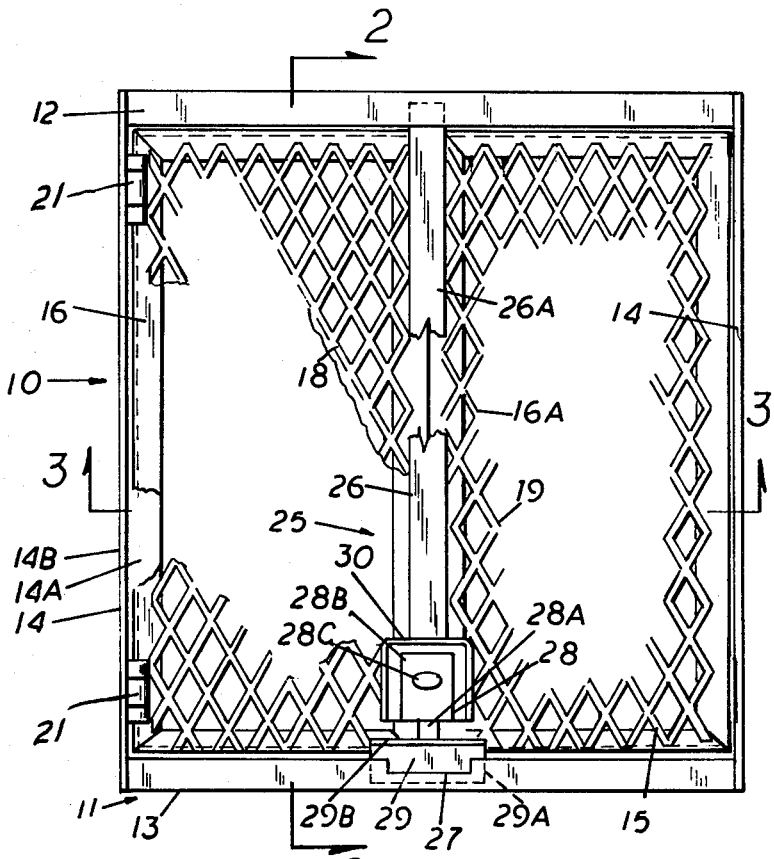
FIG. 1 is an inside front elevational view of a security gate embodying the invention.
Figure 3:
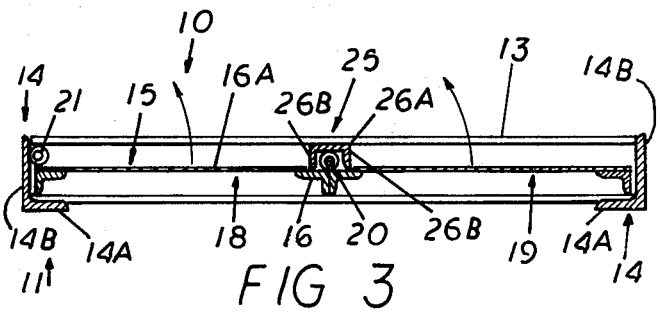
FIG. 3 is a sectional view taken along line 3—3 on FIG. 1.
Figure 5:
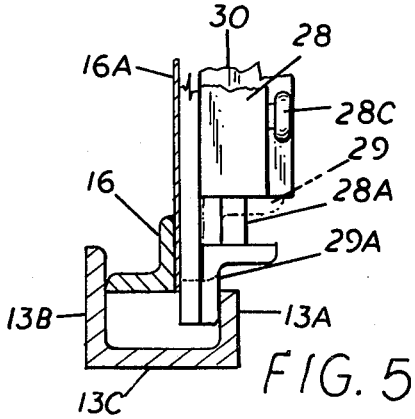
FIG. 5 is an enlarged fragmentary view of the dead bolt latching detail.

In FIGS. 1 to 3 the closure 15 is shown as being formed of two similar panel units 18 and 19 and which are hinged to fold in the open position. Thus, the adjacent sides of door panels 18 and 19 are connected by one set of hinges 20, and one of the door panels, e.g. 18 is hinged to a side member 14 of frame 11 by another set of hinges 21.

In accordance with this invention the respective described closures can be readily detachably secured in the closed position by a locking bar means 25. The locking bar means comprises a strong or rigid bar 26 which in the illustrated embodiment is formed as a channel member having a relative broad web portion 26A and a pair of connected opposed leg portions 26B for greater strength. The bar 26 is sufficiently long so as to extend between the opposed web portions 12C and 13C of the top and bottom structural members 12 and 13. To facilitate the positioning of the bar between web portions 12C and 13C, the rear flange of one of the top or bottom members is provided with a cut-out portion 27. In the illustrated embodiment the rear flange of the bottom member 13 is provided with the cut-out 27. It will be noted that the cut-out portion determines the desired location for the locking bar 26. Where folding panels are utilized, the locking bar 26 is located on the hinge axis joining the adjacent panels. Where the closure comprises a single panel unit, the locking bar 26 is perferrably disposed adjacent to the free end of the closure.

Connected adjacent to one end of the locking bar 26 is a lock in the form of a manually operated dead bolt 28 which is provided with a latch 28A which is adapted to extend and protract relative to the lock housing 28B secured to the bar 26. The arrangement is such that the latch or dead bolt 28A comprises a movable extension of the locking bar 26. Connected to the free end of the latch 28A is an angle member 29. Member 29 has a depending flange portion 29A and a horizontal or normal flange portion 29B, the latter being secured to the bolt or latch 28A. In operation, to secure the bar 26 in position to prohibit unauthorized access, the depending flange portion 29A in the projected position of the latch 28A will be extended to hook behind the rear flange 13A so as to prohibit the gate or closure from being pushed or forced inwardly of the access opening. It will be noted that a suitable turn knob 28C is operatively connected to the latch so as to effect manual protraction and retraction of the bolt latch 28A and connecting locking angle 29. In the retracted position of the bolt latch 28A, the depending flange 29A of the latching angle is shifted to a position free of the rear flange 13A which permits the locking bar 26 to be readily removed to open the closure when necessary.

To further protect the dead bolt from unauthorized tampering, a housing or shield 30 circumscribes the dead bolt. With the lock bar 26 in position to secure the closure, it will be noted that the respective ends 26D and 26E of the bar are disposed between the closure 15 and the rear flange 12A, and 13A of the respective top and bottom frame members 12 and 13.

Figure 4:
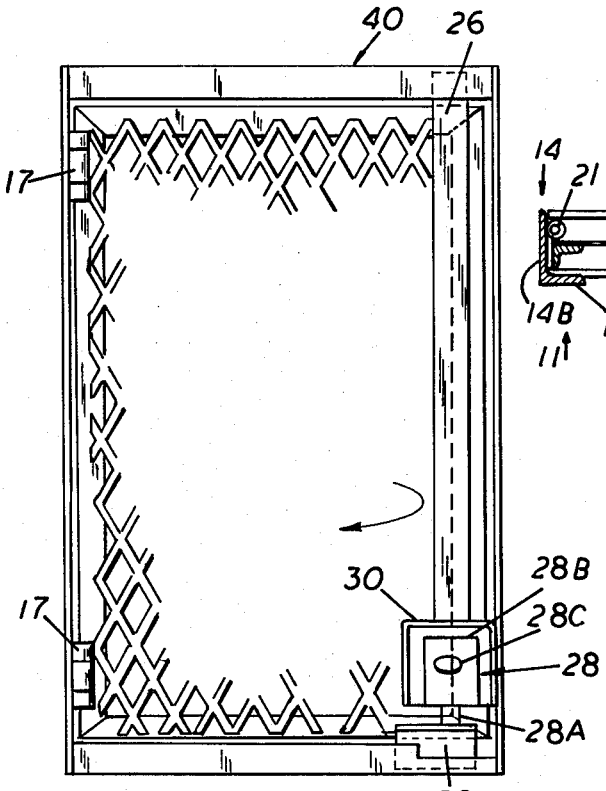
FIG. 4 is an inside front elevational view of a modified embodiment.

FIG. 4 illustrates a modified embodiment. In this embodiment the frame structure 40 is similar in structure to frame 11 of FIG. 1. In this embodiment the closure is in the form of a single panel door hinged along one side thereof to the frame 40 by hinges 17. The lock bar 26 is similar to the lock bar of FIGS. 1 to 3. However, in the embodiment of FIG. 4, the lock bar 26 is disposed along the free edge of the door. In all other respects the construction of the gate of FIG. 4 is similar to that of FIGS. 1 to 3.

While the invention has been described with respect to certain embodiments thereof, it will be understood and appreciated that variations and modifications may be made without departing from the spirit or scope of the invention.

What is claimed is:

1. A security gate for releaseably securing an access opening to prohibit unauthorized entry and which can be readily opened for rapid exit comprising, a rigid frame structure formed of rectangularly disposed structural frame members, said frame members defining opposed top and bottom members and opposed interconnected side members, said frame members defining the periphery of the opening to be secured, said top and bottom frame members, each having a rear flange disposed in the plane of said opening along the interior side of the opening and a front flange spaced therefrom and disposed in the plane of said opening on the exterior side thereof, a closure hingedly connected to one of said side members for swinging inwardly between an open and closed position, said front flanges defining a stop for said closure in the closed position;

and a securing means extending transversely of said closure between said top and bottom frame members, said securing means including a rigid bar extending between said top and bottom frame members, said bar having its opposed ends inserted between the closure and the rear flange of said top and bottom frame members, and a lock means connected to said bar, said lock means including a dead bolt arranged to extend between a latching and unlatching position, and a means connected to said dead bolt for locking said bar in position between said top and bottom frame members in the latching position;

said dead bolt defining a movable extension of said bar.

2. A security gate as defined in claim 1 wherein said closure includes a plurality of closure panels, means for hingedly connecting said panels whereby said panels can be folded onto each other in the open position, and said bar extending transversely of said closure in the closed position thereof along the hinge axis of said connected panels.

3. A security gate as defined in claim 1 wherein said means connected to said dead bolt comprises an angle member adapted to engage the flange of one of said top and bottom frame members.

4. A security gate as defined in claim 1 wherein said rigid bar comprises an elongated channel shaped member.

5. A security gate as defined in claim 1 wherein said closure comprises an peripheral closure frame formed of rigid structural members, and a lattice grill rigidly connected to said peripherial closure frame.

* * * * *